US006343486B1

(12) United States Patent
Mizukami

(10) Patent No.: US 6,343,486 B1
(45) Date of Patent: Feb. 5, 2002

(54) SUPERCRITICAL VAPOR COMPRESSION CYCLE

(75) Inventor: Harunobu Mizukami, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/588,198

(22) Filed: Jun. 6, 2000

(30) Foreign Application Priority Data

Aug. 6, 1999 (JP) ..... 11-161687

(51) Int. Cl.[7] ..... F25B 39/04
(52) U.S. Cl. ..... 62/509
(58) Field of Search ..... 62/509, 216, 217, 62/222, 228.3

(56) References Cited

U.S. PATENT DOCUMENTS

| | | | | | |
|---|---|---|---|---|---|
| 3,699,781 | A | * | 10/1972 | Taylor | 62/474 |
| 3,768,272 | A | * | 10/1973 | Barrett | 62/60 |
| 4,267,702 | A | * | 5/1981 | Houk | 62/115 |
| 4,286,438 | A | * | 9/1981 | Clarke | 62/216 |
| 4,342,200 | A | * | 8/1982 | Lowi, Jr. | 62/191 |
| 4,439,997 | A | * | 4/1984 | Cantley | 62/175 |
| 4,809,154 | A | * | 2/1989 | Newton | 364/148 |
| 4,947,655 | A | * | 8/1990 | Shaw | 62/200 |
| 5,205,131 | A | * | 4/1993 | Powlas | 62/203 |
| 5,245,836 | A | * | 9/1993 | Lorentzen et al. | 62/174 |
| 5,758,515 | A | * | 6/1998 | Howard | 62/646 |
| 5,769,610 | A | * | 6/1998 | Paul et al. | 417/228 |
| 6,134,900 | A | * | 10/2000 | Nishida et al. | 62/216 |

FOREIGN PATENT DOCUMENTS

| | | |
|---|---|---|
| JP | 6-510111 | 11/1994 |
| JP | 7-18602 | 3/1995 |
| JP | 8-504501 | 5/1996 |
| JP | 9-264622 | 10/1997 |
| WO | 90/07683 | 7/1990 |
| WO | 93/06423 | 4/1993 |
| WO | 94/14016 | 6/1994 |

* cited by examiner

*Primary Examiner*—Teresa Walberg
*Assistant Examiner*—Daniel Robinson
(74) *Attorney, Agent, or Firm*—Wenderoth, Lind & Ponack, L.L.P.

(57) ABSTRACT

A supercritical vapor compression cycle is provided having an improved cooling efficiency in the gas cooler, capable of automatically controlling the necessary circulating coolant quantity by adjusting the high side pressure. The supercritical vapor compression cycle comprises a compressor 1, a gas cooler (radiator) 2, a diaphragm resistor 4*a*, and evaporators, all of which is connected serially by a pipe 1 so as to form a closed circuit operated at the supercritical pressure at the high side, and further comprises a pressure control valve for controlling the pressure at the outlet of the gas cooler 2 so as to obtain the maximum performance factor of the supercritical vapor compression cycle, a reservoir 5, through which the pipe 6 from the outlet of the evaporator penetrates, for storing the liquid coolant 5*a*, and a communication pipe 5*b* communicating the bottom of the reservoir 5 with the pipe 6 connecting the pressure control valve with the diaphragm resistor.

4 Claims, 6 Drawing Sheets

SUPERCRITICAL VAPOR COMPRESSION CYCLE

BACKGROUND OF THE INVENTION

1. Field of the Invention

The present invention relates a vapor compression cycle applied to various devices such as air conditioning units, refrigerating machines, and heat pumps, which utilize a coolant (especially, $CO_2$) driven under supercritical conditions at a high side in a closed system.

2. Background Art

In the supercritical vapor compression cycle, a few techniques have been proposed for controlling the high side pressure by adjusting the circulating coolant. An example is shown in Japanese Patent Publication No. Hei 7-18602). This supercritical vapor compression cycle comprises, as shown in FIG. 6, a compressor 100 serially connected to the radiator 110, a countercurrent-type heat exchanger 120, and a throttle valve 130. An evaporator 140, a liquid separator (a receiver) 160, and the low pressure side of the countercurrent heat exchanger 120 are connected so as to communicate each other to an intermediate point between the throttle valve 130 and a inlet 190 of the compressor 100. The receiver 160 is connected to the outlet 150 of the evaporator 150 and the gas phase inlet of the receiver is connected to the countercurrent heat exchanger 120. A liquid phase line (shown by a broken line) from the receiver 160 is connected to a suction line at an optional point between a point 170 located at the front side of the countercurrent-type heat exchanger 120 and a point 180 located at the back side on the heat exchanger 120. The above-described throttle valve 130 changes the residual quantity of the liquid in the receiver 160 for adjusting the high side supercritical vapor pressure. A conventional example shown in FIG. 7 comprises, instead of the receiver, an intermediate liquid reservoir 250, provided with respective valves at both inlet and outlet sides, and a throttle valve 130, connected in parallel with the reservoir 250.

Recently, a new vapor compression refrigerating cycle using $CO_2$ (hereinafter, called the $CO_2$ cycle) is proposed as one alternative for eliminating freon-type coolants. The operation of this $CO_2$ cycle is the same as that of the conventional vapor compression-type refrigerating cycle using freon. That is, operations include, as shown by A-B-C-D-A in FIG. 3 ($CO_2$ Mollier chart), compressing $CO_2$ in the vapor phase (A-B), and cooling the compressed and high temperature vapor phase $CO_2$ by the radiator (gas cooler) (B-C). Then, the operation continues for reducing the pressure of the vapor phase $CO_2$ by the pressure reducing device (C-D), evaporating $CO_2$ separated into two gas-liquid phases (D-A), and cooling the outside fluid by removing the latent heat of vaporization from the outside fluid.

The critical temperature of $CO_2$ is 31° C., which is lower than that of conventional freon. Thus, in hot seasons like summer, the temperature of $CO_2$ near the radiator becomes higher than the critical temperature of $CO_2$. Thus, $CO_2$ gas does not condense (the line segment BC does not cross the saturated liquid line). Since the state of the outlet point of the radiator (point C) is determined by the discharge pressure of the compressor and the temperature of $CO_2$ at the radiator outlet and since the $CO_2$ temperature at the radiator outlet is determined by the heat dissipation capacity and the temperature of the outside air (this is not controllable), the temperature of the radiator outlet is substantially uncontrollable. The state at the radiator outlet (point C) becomes controllable by controlling the discharge pressure (pressure at the radiator outlet) of the compressor. That is, in order to preserve a sufficient cooling capacity (the enthalpy difference) when the temperature of the outside air is high like in summer, it is necessary to make the pressure of the radiator outlet high as shown by E-F-G-H-E in FIG. 4.

However, since the discharge pressure of the compressor must be raised in order to raise the radiator outlet pressure, the work of compression done by the compressor (an enthalpy variation A L in the compression process) increases. Thus, if the enthalpy variation A L in the compression process (A-B) is larger than the enthalpy variation A I of the evaporation process (D-A), the performance factor of the $CO_2$ cycle ($COP=\Delta I/\Delta L$) is lowered. When the relationship between the $CO_2$ pressure at the radiator outlet and the performance factor is calculated with reference to FIG. 3, assuming that the temperature of $CO_2$ at the radiator outlet is 40° C., the maximum performance factor is obtained at the pressure P, as shown by the solid line in FIG. 5. Similarly, when the temperature of the $CO_2$ gas at the radiator outlet side is assumed at 30° C., the maximum performance factor is obtained at a pressure $P_2$ (approximately 8.0 MPa).

As shown above, when the $CO_2$ temperatures at the radiator outlet and the pressure for obtaining the maximum performance factor are calculated and plotted, the bold solid line $\eta_{max}$ (hereinafter, called the optimum control line) is yielded. Therefore, in order to operate the $CO_2$ efficiently, it is necessary to control both of the radiator outlet pressure and the $CO_2$ temperature at the radiator outlet so as to be correlated as shown by the optimum control line $\eta_{max}$.

However, since the above described supercritical vapor compression cycle (FIGS. 6 and 7) is not the system in which the radiator outlet pressure (high side pressure) is controlled in correspondence to the coolant temperature at the radiator outlet, and the cooling efficiency at the radiator is not sufficiently high, there is room to improve cooling efficiency. Another problem arises that, when the circulating coolant quantity must be controlled to correspond to the control of the high side pressure (a larger amount of circulating coolant is necessary as the high side pressure increases), the opening of the throttle valve must be adjusted manually whenever it is necessary, which is a time consuming operation and requires much experience.

SUMMARY OF THE INVENTION

The present invention is realized in order to overcome the above problems, and thus, it is therefore an objective of the present invention to provide a supercritical vapor compression cycle, provided with a gas cooler (radiator) having an improved cooling efficiency, and capable of automatically controlling the necessary circulating coolant quantity in accordance with an adjustment of the high side pressure.

According to a first aspect of the present invention, a supercritical vapor compression cycle is provided by serially connecting a compressor, a gas cooler, a diaphragm device, and an evaporator by a pipe so as to constitute a closed circuit to be operated at a supercritical pressure at the high pressure side in vapor compression cycle, which comprises: a pressure control valve, provided between said gas cooler and said diaphragm device, for controlling a pressure at an outlet of said gas cooler; a reservoir, through which a pipe from the outlet of said evaporator penetrates, for storing a liquid coolant; and a communication pipe for communicating between the bottom of said reservoir and the pipe connecting said pressure control valve with said diaphragm device.

According to the second aspect, the supercritical vapor compression cycle according to the first aspect further comprises an intercooler for executing heat change between the liquid coolant which has passed through said evaporator and the gas coolant which has passed through said evaporator, wherein said pressure control valve is disposed at a pipe from the outlet of said intercooler.

According to the third and fourth aspects, in a supercritical vapor compression cycle according to the first or the second aspect, the coolant used in the cycle is carbon dioxide.

DETAILED DESCRIPTION OF THE INVENTION

Figure 1:
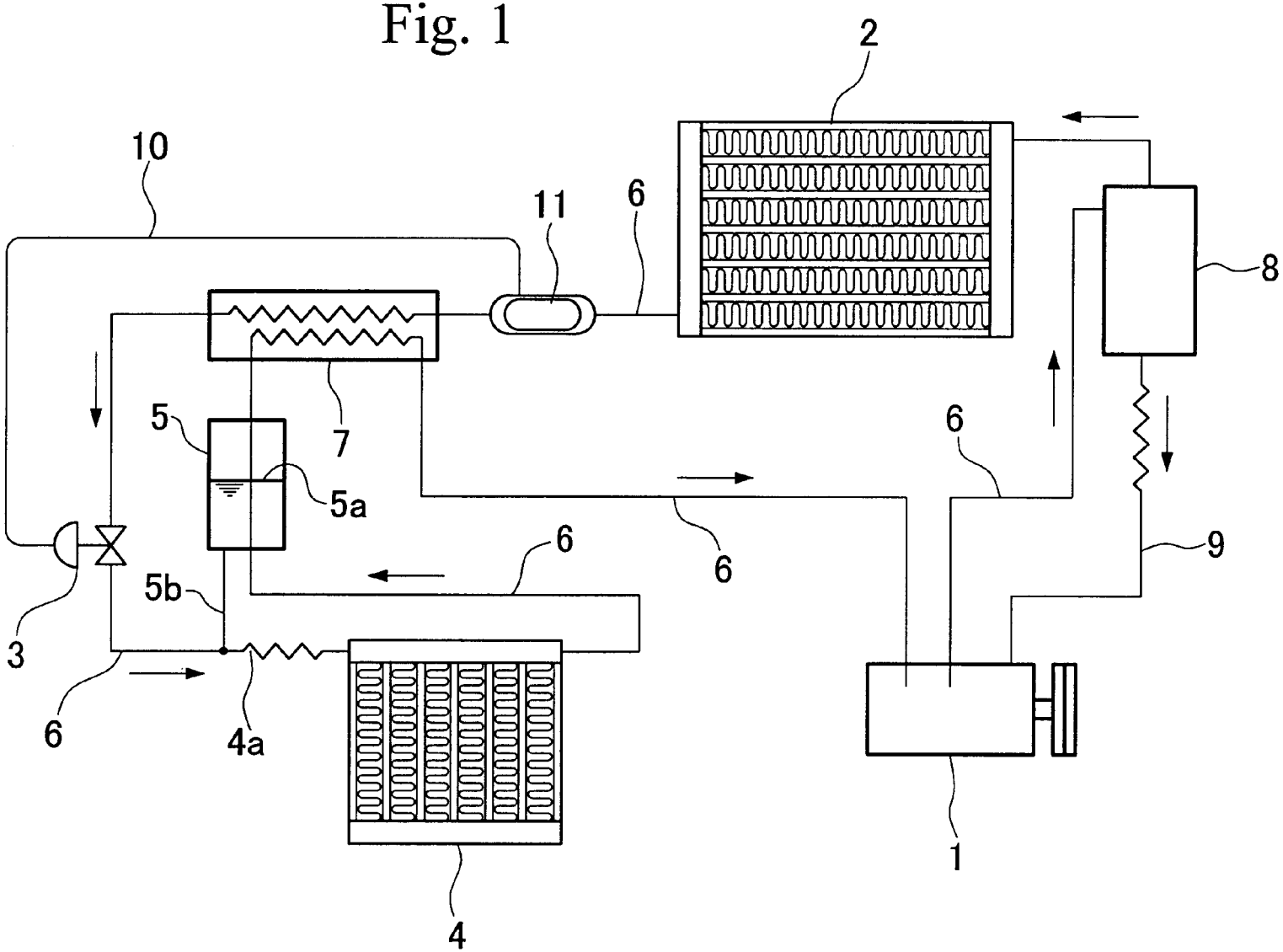
FIG. 1 is a diagram showing the structure of vapor compression-type refrigerating cycle according to one embodiment of the present invention.
Figure 2:
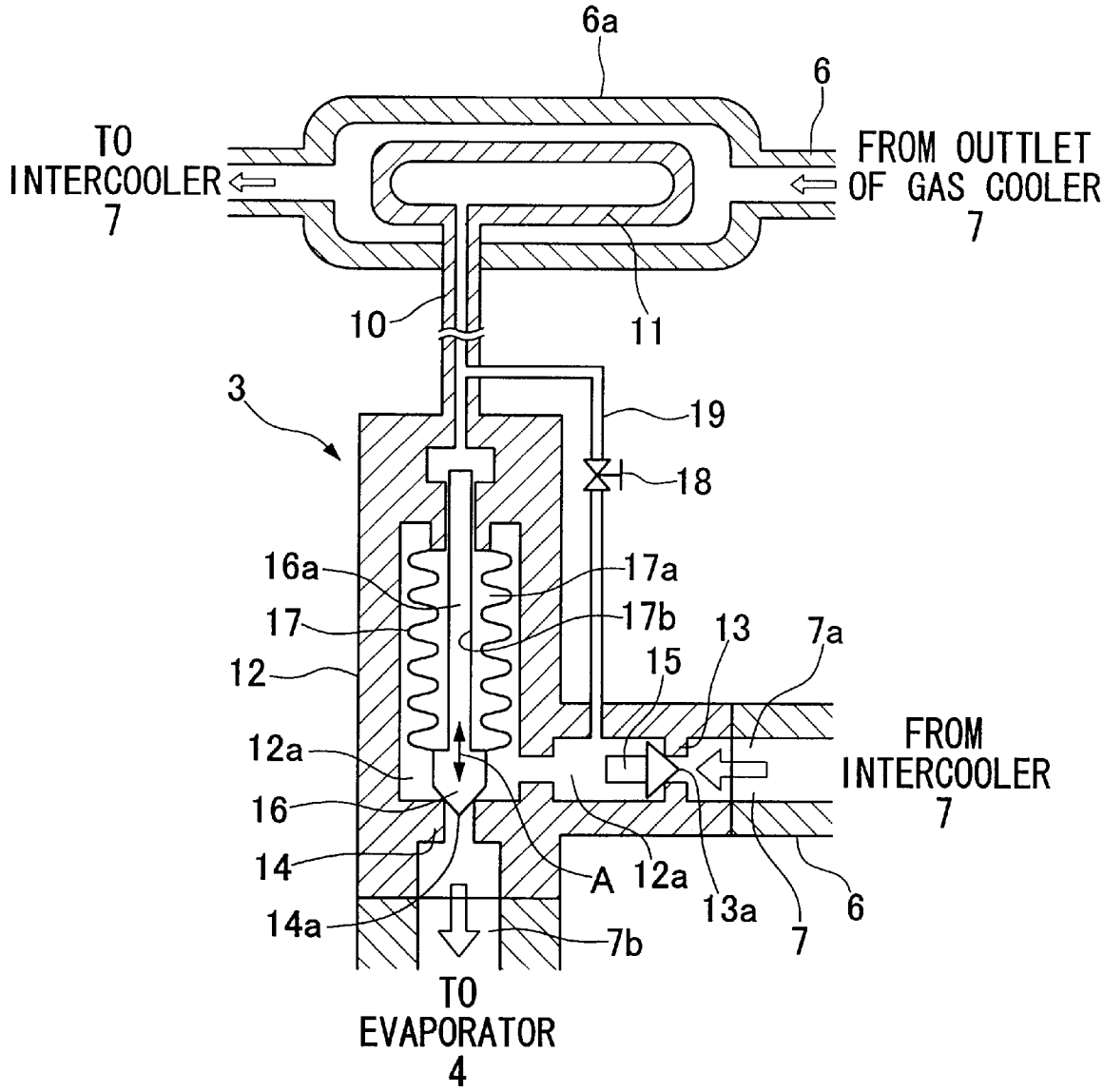
FIG. 2 is a cross-sectional view showing the detail of the pressure control valve shown in FIG. 1.

Hereinafter, one embodiment of the present invention is described with reference to the attached drawings. FIG. 1 is a diagram showing the structure of a vapor compression-type refrigerating cycle according to one embodiment of the present invention. FIG. 2 is a cross-sectional view showing the detail of the pressure control valve shown in FIG. 1.

First, as shown in FIG. 1, the vapor compression type refrigerating cycle using a pressure control valve according to the present embodiment is a $CO_2$ cycle which is applicable to, for example, an on vehicle air conditioning apparatus, and the reference numeral 1 denotes a compressor for compressing the vapor phase $CO_2$. The compressor 1 is driven by a driving source such as an engine (not shown). The numeral 2 denotes a gas cooler (a radiator) for cooling the $CO_2$ gas by heat exchange between the $CO_2$ gas and the outside air, and the numeral 3 denotes a pressure control valve disposed at the outlet piping of an intercooler 7, which is described later. The pressure control valve 3 controls the pressure at the outlet of the gas cooler 2 (in this embodiment, the high side pressure at the outlet of the intercooler) in response to the $CO_2$ temperature (coolant temperature) detected by a temperature sensitive cylinder 11 at the outlet of the gas cooler 2. The pressure control valve 3 not only controls the high side pressure, but also operates as the pressure reduction device, and the structure and the operation of the pressure control valve 3 will be described later in detail. The gas phase $CO_2$ is subjected to pressure reduction by the pressure control valve 3 and is converted into a low temperature and low pressure $CO_2$ in the gas-liquid two phase state. The thus converted $CO_2$ is further subjected to the pressure reduction by a diaphragm resistor (a diaphragm device) 4*a*.

The numeral 4 denotes an evaporator, which constitutes a cooling device in a car compartment. While the gas liquid two phase $CO_2$ vaporizes (evaporates) in the evaporator 4, the $CO_2$ absorbs the evaporative latent heat from air in the car compartment and cools the compartment. The numeral 5 denotes a liquid reservoir for storing the liquid coolant 5*a* and a pipe 6 connected with the outlet of the evaporator 4 is constituted to penetrate vertically through the liquid reservoir 5 such that the liquid coolant 5*a* in the liquid reservoir 5 can be subjected to the heat exchange with the liquid coolant in the pipe 6. The penetrated portion of the liquid reservoir 5 by the pipe 6 is sealed (not shown) such that the liquid reservoir becomes air tight. It is to be noted, in order to raise the efficiency of the heat exchange, although it is preferable for the pipe 6 from the evaporator 4 outlet to penetrate through the liquid reservoir 5 so as to be contact with the liquid coolant 5*a* in the liquid reservoir 5, the structure is not limited to such a constitution. The bottom of the liquid reservoir 5 is connected with a pipe 6, which connects the pressure control valve 3 to the diaphragm resistor 4*a*, by a communication pipe 5*b*. The intercooler 7, although not necessarily required to be provided, is a countercurrent-type heat exchanger for heat exchanging between the liquid coolant passing through the gas cooler 2 and the gas coolant passing through the evaporator, and this intercooler 7 is used for improving the response speed in accordance with the capacity increasing requirement of the vapor compression-type refrigerating cycle. It is preferable to dispose the pressure control valve 3 adjacent to the outlet of the gas cooler 2, when the intercooler 7 is not provided. The compressor 1, the gas cooler 2, the intercooler 7, the pressure control valve 3, the diaphragm resistor 4*a*, and the evaporator 4 are respectively connected by a pipe 6 for forming a closed circuit ($CO_2$ cycle). The numeral 8 denotes an oil separator for scavenging a lubrication oil from the coolant gas discharged from the compressor 1, and the lubrication oil after being scavenged is returned to the compressor by an oil return pipe 9.

As shown in FIG. 2, a valve body 12 (a valve casing) of the pressure control valve 3 is disposed in a coolant path 7 (in this example, the $CO_2$ path) formed by the pipe 6 at a location in between the intercooler 7 and the restrictor resistor 4*a*. The valve body 12 is arranged so as to partition the coolant path 7 into the upstream space 7*a* and the downstream space 7*b*, and at both ends of the valve body 12, crossing at a right angle, a first partition wall 13 which forms a boundary for defining the upstream space 7*a* of the coolant path 7, and a second partition wall 14, which forms a boundary for defining the downstream space 7*b*. A first orifice 13*a* (an opening) and a second orifice 14*a* (an opening) are respectively formed in the first parathion wall 13 and the second partition wall 14.

In the internal space 12*a* of the valve body 12, a bellows extensible vessel 17 is configured for forming the sealed space 17*a*, and this extensible vessel 17 expands and contracts in the axial direction (the vertical direction shown by the arrow A in FIG. 2). The base end (the top end in FIG. 2) of the extensible vessel 17 is fixed with the inner wall of the valve body 12, a valve rod 16*a* having a valve 16 at its top end is movably inserted through the hollow portion 17*b* in the axis center of the extensible vessel 17. This valve 16 is fixed at the top end of the extensible vessel 17 and the valve is facing the second orifice 14*a* in the second partition wall 14. The valve rod 16*a* moves mechanically interlocking with extension and contraction of the extensible vessel 17. When the pressure difference between the inside and outside of the sealed space 17*a* of the extensible vessel 17, and when the extensible vessel 17 is in an unloaded condition, the valve 16 closes the second orifice 14*a*.

The numeral 15 denotes a check valve, provided inside of the valve body 12, for opening and closing the first orifice 13*a*. This check valve 15 is used for opening the first orifice 13*a* when the internal pressure of the upstream space 7*a* becomes higher than the internal pressure of the valve body 12 by a predetermined value. The check valve 15 is pressed against the first orifice 13*a* by a biasing means (such as a coil spring) and a predetermined initial load always operates on the check valve 15. This initial load constructs the above described predetermined value.

The sealed space of the extensible vessel 17 communicates with the temperature sensitive cylinder 11 through a capillary tube 10 (a tube ember). This temperature sensitive cylinder 11 is received in a large diameter portion 6*a* of the pipe 6 near the outlet of the gas cooler 2, and the temperature sensitive cylinder 11 is used for detecting the temperature of the coolant in the pipe 6 and for informing the result to the extensible vessel 17. In this embodiment, the temperature sensitive cylinder 11 is provided in a pipe 6 for obtaining a good thermal response, but it may be possible to provide at the outside of the pipe 6.

A communicating tube 19 (a fine tube) is used for communicating the internal space 12*a* of the valve body 12 and the intermediate portion of a capillary tube 10 (a tube member), and this communicating tube 19 comprises a shut off valve 18. When this shut off valve 18 is closed, the internal space 12*a* of the valve body 12 and the sealed space 17*a* of the extensible vessel 17 are cut off and independent spaces are formed.

The present vapor compression type refrigerating cycle is a cycle using $CO_2$, the coolant gas ($CO_2$ gas) fills in the valve body 12, the extensible vessel 17, the temperature sensitive cylinder 11, and the capillary tube 10 at a density within a predetermined density range from the saturated liquid density at the gas temperature of 0° C. to the saturated liquid density at the critical temperature of the coolant, when the valve 16 and the check valve are closed.

Next, a method of using the pressure control valve 3 and an operation of the pressure control valve 3 are described.

First, at the time of initial setting, the $CO_2$ gas is introduced into the sealed space 17*a* of the extensible vessel 17 and the temperature sensitive cylinder 11 after passing through the communicating tube 19 and the capillary tube 10 by introducing the $CO_2$ gas into the valve body 12 through the first orifice 13*a* while maintaining the shut off valve open. When the introduction of the $CO_2$ gas is completed, the internal space 12*a* of the valve body 12 and the sealed space 17*a* of the extensible vessel 17 are cut off and isolated from each other to form respective individual spaces without having internal pressure differences by automatically closing the check valve and by closing the shut off valve. Thereby, the pressure in the sealed space 17*a* of the extensible vessel 17 has a pressure corresponding to the temperature of the temperature sensitive cylinder 11, and the outside pressure of the extensible vessel 17 corresponds to that of the valve body 12, so that the pressure difference between the outside pressure and the inside pressure of the extensible vessel 17 does not increase, as long as a large temperature difference does not occur. Accordingly, the extensible vessel is not subjected to excessive deformation so that it is possible to prevent degradation of the elastic restoring force and fracture of the extensible vessel 17. When the $CO_2$ temperature at the outlet of the intercooler 7 is assumed to be 40±1° C., it is preferable to set the pressure of the filling $CO_2$ gas at 10.5±0.5 MPa, in order to obtain a maximum performance factor.

When the initial setting is completed, the first orifice 13*a* and the second orifice 14*a* are closed by means of the check valve 15 and the valve 16, respectively.

When the $CO_2$ cycle is operated by activating the compressor 1 and when the pressure in the upstream space 7*a* of the pressure control valve 3 exceeds the internal pressure of the valve body 12, the first orifice is opened by the movement of the check valve 15; thereby the $CO_2$, gas enters into the valve body 12. When the internal pressure of the valve body exceeds the internal pressure of the extensible vessel 17, the second orifice opens by the movement of the valve 16 and the $CO_2$ gas circulates in the pipe 6. At this time, the temperature in the extensible vessel 17 becomes identical with the outlet temperature of the gas cooler 2 through the temperature of the temperature sensitive cylinder 11, by the thermal conduction of the introduced $CO_2$ gas. Thus, the internal pressure of the extensible vessel 17 is a balanced pressure determined by the temperature of circulating $CO_2$ gas.

When the internal pressure of the valve body 12 is larger than this balanced pressure, the second orifice is opened, whereas, when the internal pressure of the valve body 12 is smaller than the balance pressure, the second orifice is maintained closed. Thereby, the balanced pressure is automatically maintained at the internal pressure of the valve body 12. That is, the outlet pressure of the intercooler 7 is controlled by controlling the $CO_2$ gas temperature at the outlet of the gas cooler 2.

Practically, for example, when the outlet temperature of the gas cooler 2 is 40° C., and when the outlet pressure of the gas cooler 2 is less than 0.7 MPa, the compressor 1 absorbs the $CO_2$ gas from the intercooler 7, and discharge the $CO_2$ gas toward the gas cooler 2. Thereby, the outlet pressure of the gas cooler 2 increases (as shown b'→c'→b"→c" in FIG. 3). When the outlet pressure of the gas cooler 2 exceeds approximately 10.7 MPa (B-C), the pressure control valve 3 opens, so that the $CO_2$ gas is converted into the gas-liquid two-phase $CO_2$ (C-D) and the thus converted gas-liquid $CO_2$ flows into the evaporator 4. $CO_2$ is vaporized in the evaporator 4 (D-A), and returns to the intercooler again after cooling air. At this period, since the outlet pressure of the gas cooler 2 is reduced again, the pressure control valve 3 is again closed.

That is, the $CO_2$ cycle is the system used for cooling air by reducing the pressure and evaporating $CO_2$ after raising the outlet pressure of the gas cooler 2 to a predetermined pressure by closing the pressure control valve 3.

As described above, the high pressure control valve 3 according to the present embodiment is operated so as to be opened after raising the outlet pressure of the gas cooler 3 to a predetermined value, and the control characteristic of the high pressure control valve 3 is largely depend upon the pressure characteristic of the sealed space of the high pressure control valve 3.

Figure 3:
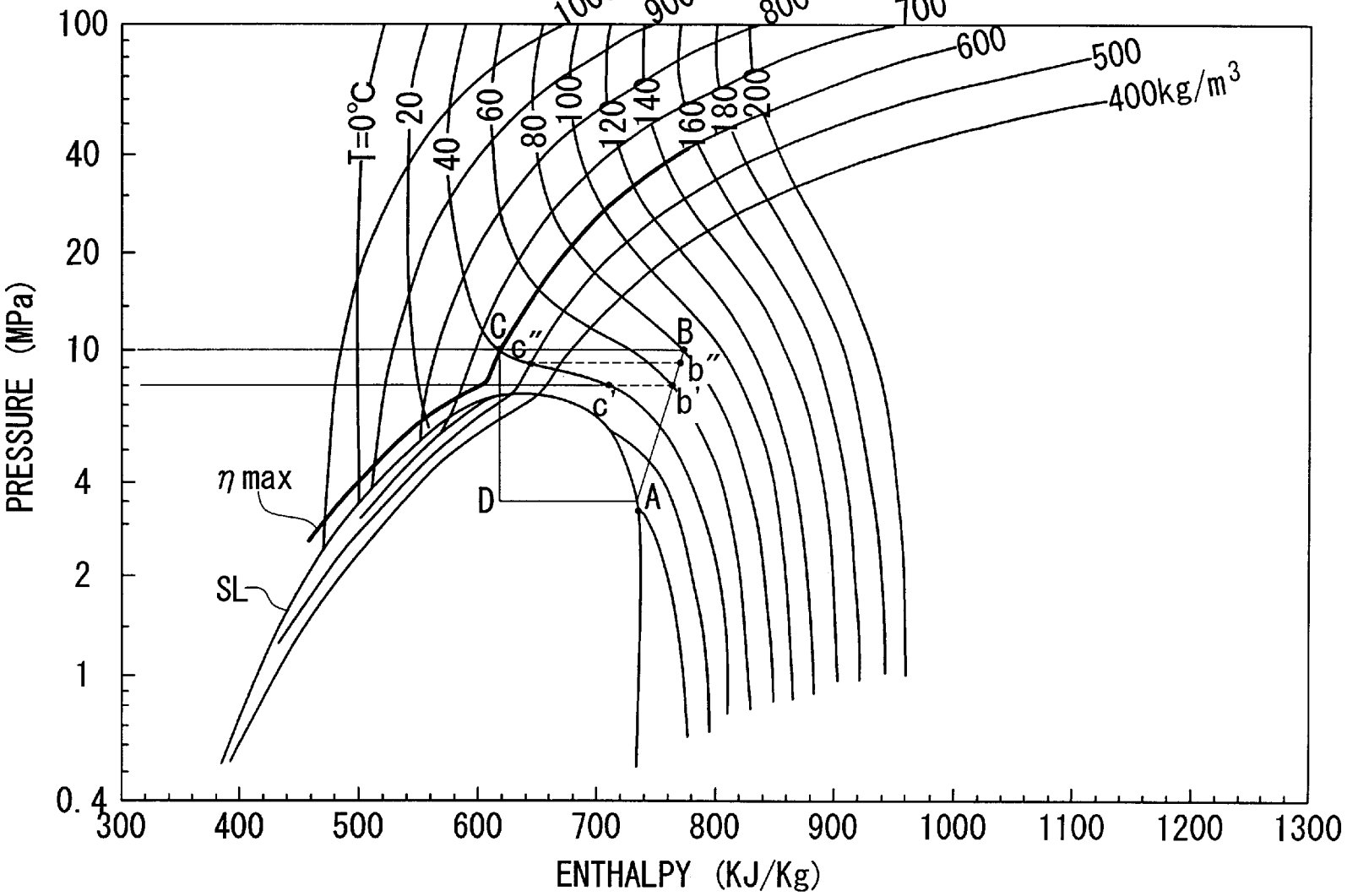
FIG. 3 is a graph for explaining an operation of the vapor compression type refrigerating cycle.
Figure 4:
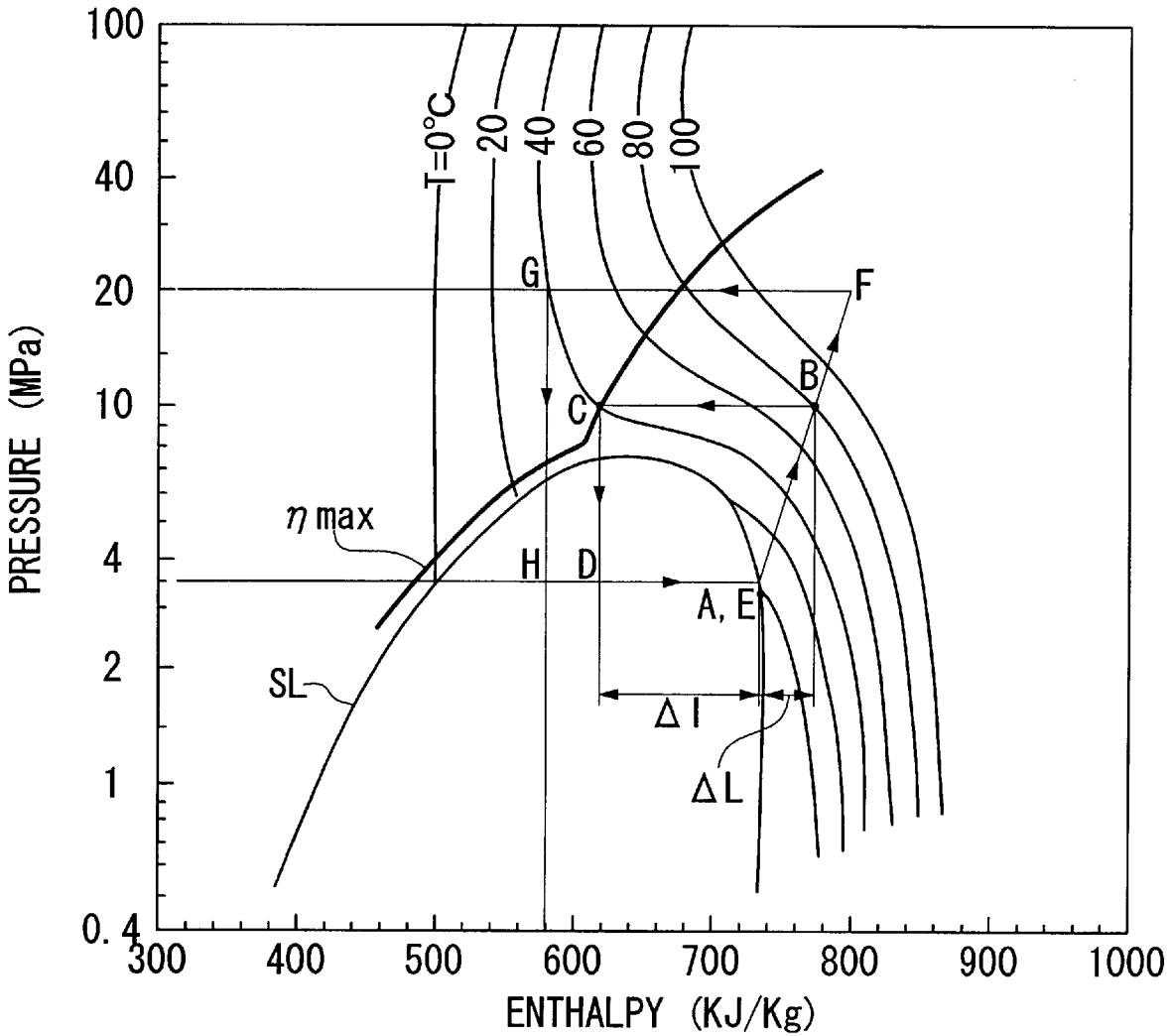
FIG. 4 is a Mollier chart for $CO_2$.
Figure 5:
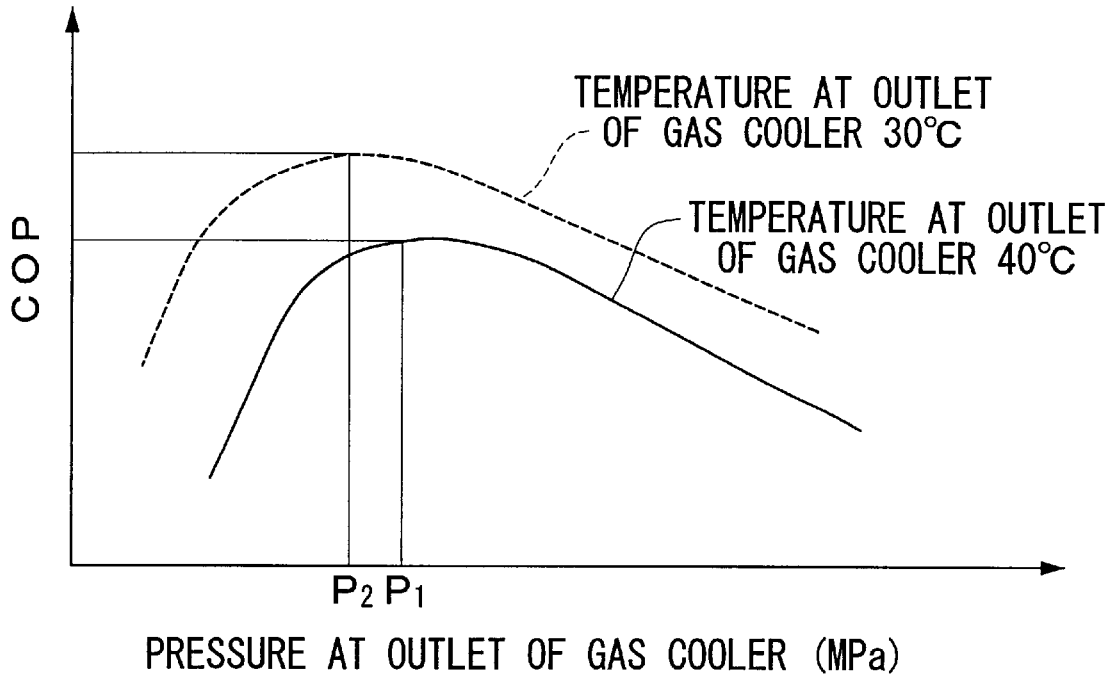
FIG. 5 is a diagram showing the relationship between the performance factor (COP) and the pressure at the radiator outlet.
Figure 6:
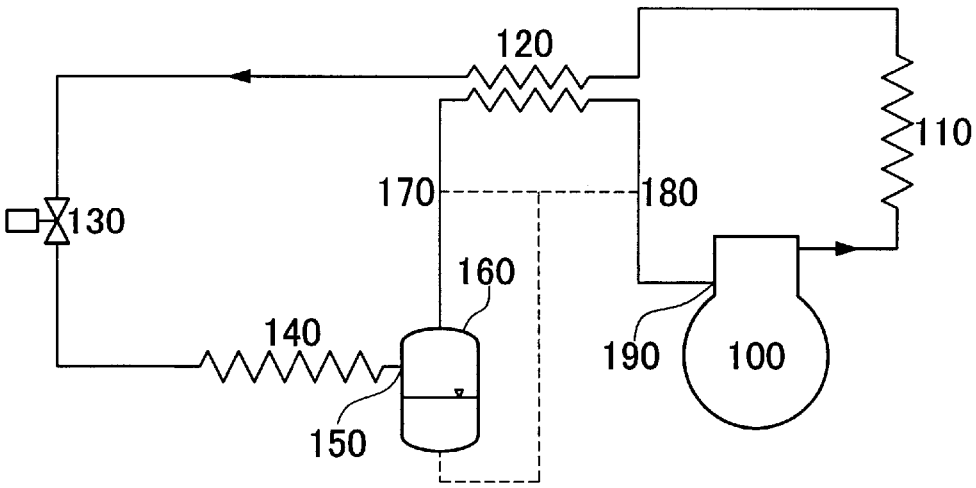
FIG. 6 is a diagram showing a structure of an example of the conventional vapor compression type refrigerating cycle.
Figure 7:
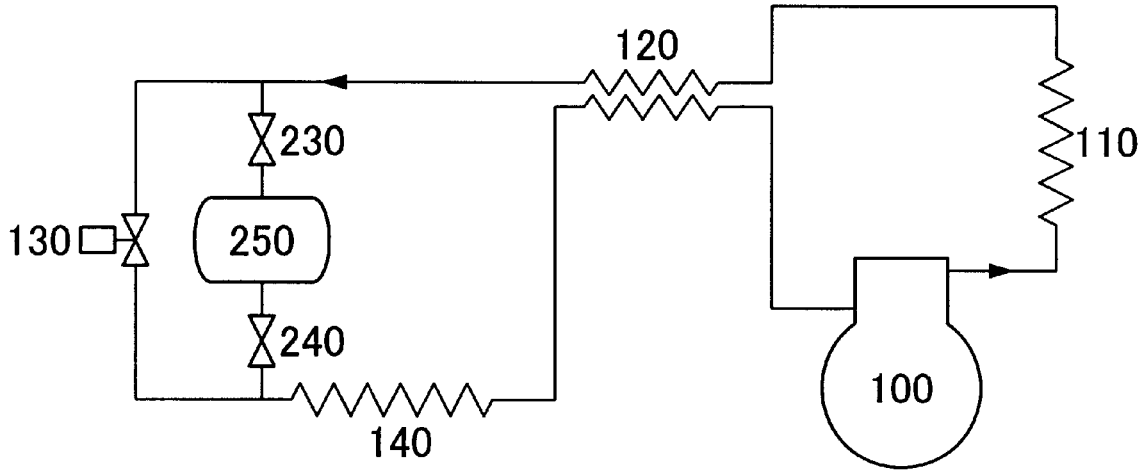
FIG. 7 is a diagram showing a structure of another example of the conventional vapor compression type refrigerating cycle.

As shown in FIG. 3, the isopycnic line at 600 kg/cm$^2$ in the supercritical zone approximately coincides with the above described optimum control line $\eta_{max}$. Thus, since the pressure control valve according to the present embodiment raises the pressure at the outlet of the gas cooler 2 approximately along the optimum control line $\eta_{max}$, it is possible to operate the $CO_2$ cycle efficiently even in the supercritical zone. In addition, when the pressure is lower than the supercritical zone, although the isopycnic line at 600 kg/cm$^2$ diverges largely from the optimum control line $\eta_{max}$, the pressure is in the condensation zone and the internal pressure of the sealed space varies with the saturated liquid line SL. In addition, practically, it is preferable to fill $CO_2$ in the sealed space within a pressure range from the saturated liquid density at 0° C. to the saturated liquid density at the critical point of $CO_2$.

Next, an automatic control of a circulating coolant quantity, that is one of the features of the present embodiment, will be described.

First, when the coolant temperature at the outlet of the gas cooler 2 is lowered, the pressure of the coolant between the pressure control valve 3 and the diaphragm resistor 4*a* increases by the increase of the opening of the pressure control valve 3, in order to reduce the high side pressure so as to obtain the maximum performance factor of the supercritical vapor compression cycle. Thereby, a part of the coolant in the pipe 6 between the pressure control valve 3 and the diaphragm resistor 4*a* flows into the liquid reservoir 5 through the communicating pipe 5*b*, and, as a result, the circulating coolant quantity in the cycle reduces.

On the other hand, when the temperature of the coolant at the outlet of the gas cooler 2 increases, the coolant pressure in the pipe 6 between the pressure control valve 3 and the diaphragm resistor 4*a* decreases by reducing the opening of the pressure control valve 3, in order to increase the high side pressure so as to obtain the maximum performance factor of the supercritical vapor compression cycle. Thereby, the coolant in the liquid reservoir flows into the pipe 6 between the pressure control valve 3 and the diaphragm resistor 4*a* through the communication pipe 5*b*, and, as a result, the circulating coolant quantity in the cycle automatically increases.

When the capacity of the cycle is deficient due to the reduced amount of the coolant output from the evaporator 4, the coolant which is flowed out from the evaporator 4 enters a superheated state. Passage of such superheated coolant through the liquid reservoir 5 allows heating of the coolant in the reservoir 5 and when the pressure of the liquid coolant exceeds the saturated pressure, the liquid coolant flown into the pipe 6 between the pressure control valve 3 and the diaphragm resistor 4*a* through the communication pipe 5, which results in an increase in the circulating coolant quantity in the cycle and an increase in the capacity of the cycle.

When the coolant quantity output from the evaporator 4 increases and the capacity of the cycle becomes excessive, the coolant from the evaporator 4 cools the liquid coolant in the reservoir 5 when passing, and the thus cooled coolant having a reduced pressure compared with the saturated pressure input into the reservoir 5 through the communication pipe 5*b*, which results in reducing the circulating quantity of the coolant in the cycle and reduces the capacity of the cycle.

Since the supercritical vapor compression cycle of the present invention is constructed as described above, and since the outlet pressure of the gas cooler (high side pressure) is controlled in according with the cooling temperature at the outlet of the gas cooler, the cooling efficiency of the gas cooler can be improved. In addition, the quantity of the circulating coolant an be automatically controlled according to the control of the high side pressure (the required quantity of the circulating coolant increases as the high side pressure increases), so that it is possible to save the trouble of adjusting the opening of the throttle valve.

As described in the second aspect, provision of the intercooler for executing a heat exchange between the liquid coolant and the gas coolant after evaporation by the evaporator allows improving the response speed for a requirement to increase the capacity of the vapor compression-type refrigerating cycle.

As described in the third aspect, the present cycle is preferable to be applied to the supercritical vapor compression-type cycle using the carbon dioxide.

What is claimed is:

1. A supercritical vapor compression cycle, provided with a compressor, a gas cooler, a diaphragm device, and an evaporator serially connected by a pipe so as to constitute a closed circuit to be operated at a supercritical pressure at the high pressure side in the vapor compression cycle, comprising:

a pressure control valve, provided between said gas cooler and said diaphragm device, for controlling a pressure at an outlet of said gas cooler;

a reservoir, through which a pipe from the outlet of said evaporator penetrates, for storing a liquid coolant; and a communication pipe for communicating between the bottom of said reservoir and the pipe connecting said pressure control valve with said diaphragm device.

2. A supercritical vapor compression cycle according to claim 1, the supercritical vapor compression cycle further comprises an intercooler for performing heat change between the liquid coolant which has passed through said evaporator and the gas coolant which has passed through said evaporator, wherein said pressure control valve is disposed at a pipe output from the outlet of said intercooler.

3. A supercritical vapor compression cycle according to claim 1, wherein the coolant used in the cycle is carbon dioxide.

4. A supercritical vapor compression cycle according to claim 2, wherein the coolant used in the cycle is carbon dioxide.

* * * * *

UNITED STATES PATENT AND TRADEMARK OFFICE

CERTIFICATE OF CORRECTION

PATENT NO. : 6,343,486 B1
DATED : February 5, 2002
INVENTOR(S) : Harunobu Mizukami It is certified that error appears in the above-identified patent and that said Letters Patent is hereby corrected as shown below:

Title page,
Item [30], Foreign Application Priority Data change "Aug. 6, 1999" to
-- Jun. 8, 1999 --.

Signed and Sealed this

Twenty-seventh Day of August, 2002

*Attest:*

*Attesting Officer*

JAMES E. ROGAN
*Director of the United States Patent and Trademark Office*